United States Patent [19]

Horton

[11] 4,285,598

[45] Aug. 25, 1981

[54] CONCRETE MIXING APPARATUS

[76] Inventor: Thomas Horton, 2220 Kenbridge Cir., Hoover, Ala. 35226

[21] Appl. No.: 102,434

[22] Filed: Dec. 10, 1979

[51] Int. Cl.[3] ..... B28C 5/12; B28C 5/42; B28C 7/06; B28C 7/12

[52] U.S. Cl. ..... 366/15; 222/137; 222/276; 366/19; 366/27; 366/32; 366/34; 366/37; 366/64

[58] Field of Search ..... 366/14, 15, 16, 19, 366/27, 30, 32, 33, 34, 37, 38, 40, 64; 222/137, 275, 276, 361

[56] References Cited

U.S. PATENT DOCUMENTS

| | | | |
|---|---|---|---|
| 1,557,839 | 10/1925 | Hodgson | 366/40 X |
| 3,058,625 | 10/1962 | Greaves | 222/137 |
| 3,456,925 | 7/1969 | Gallagher | 366/27 |
| 3,604,057 | 9/1971 | Nixdorff, Jr. | 222/137 X |
| 3,666,146 | 5/1972 | Robinson | 222/137 X |
| 3,746,313 | 7/1973 | Weeks et al. | 366/19 |
| 3,807,706 | 4/1974 | Kugle et al. | 366/27 |

*Primary Examiner*—Philip R. Coe

*Attorney, Agent, or Firm*—Birch, Stewart, Kolasch & Birch

[57] ABSTRACT

A concrete mixing machine is disclosed which mixes small batches of concrete using any desired ratio of gravel, sand, cement, and water. The dry materials are mixed into concrete at the site where the concrete is to be poured. The apparatus includes hoppers for storing the dried mix material, a water tank, a metering slide for measuring desired amounts of cement, sand, and gravel to the desired proportions; a mixing, feeding, and dispensing system; and a hydraulic system for driving the mixing apparatus. The hydraulic drive system is utilized to overcome the binding which occurs when residual concrete begins to set.

14 Claims, 16 Drawing Figures

42
41
82
88
133
144
92
92
156
155
154
64
153
151
152
149
150
147
148
145
146
143
142
14
113
139
138
135
134
131
130
128
127
137
20
16
129
136
159
158
24
28
30
41
43
132
141
115
119
56
157
126
132
110
125
111

CONCRETE MIXING APPARATUS

BACKGROUND OF THE INVENTION

1. Field of Invention

The present invention relates to a concrete measuring and mixing apparatus which allows the operator to selectively vary the composition of the concrete mix at the job site. More specifically, the present invention relates to a concrete mixing apparatus, detachably mounted on a standard truck frame, which takes sand, cement, gravel, and water and mixes them in desired proportions at the job site to produce small batches of concrete of a desired composition, when needed.

2. Description of the Prior Art

The use of a common type of concrete mixing truck has a disadvantage in that the truck can only be used for simultaneous mixing and transport of large amounts of ready-mixed concrete. It does not meter various quantities of cement, gravel, sand, and water in optionally variable proportions at the job site. Thus, the distance between the mixing site and the job site must be taken into account to allow for setting of the concrete. When the truck contains more than the amount of concrete needed at a given job site the rest must be poured relatively quickly, often as waste. Also, an extensive stationary batch plant for metering the concrete materials is necessary.

Another type of concrete mixing apparatus is shown in U.S. Pat. No. 3,746,313 to Weeks et al. The mixing apparatus of this patent mixes separate amounts of cement, sand, gravel, and water to produce concrete at the job site as does the present invention. However, many features of the prior art mixing apparatus render it ineffective for commerical use. The apparatus of this prior art patent was unbalanced, and therefore unstable on the highway. The mixing drum in this apparatus was ineffective and subject to clogging. The conveyors in this patent would wear fast and were also subject to clogging. The mechanical drive was delicate and developed insufficient force to overcome binding. And most importantly, the metering slide of this prior art patent would stick and lock up with cement when damp. However, these problems have been corrected by the invention of the present application.

SUMMARY OF THE INVENTION

Accordingly, it is the primary object of the present invention to provide a useful commercial measuring and mixing apparatus for concrete which is capable of mixing desired amounts of concrete in desired proportions at the job site.

It is another object of the present invention to provide a concrete measuring and mixing apparatus which does not have the sensitivity to binding present in the prior art devices.

It is a further object of the present invention to provide a concrete measuring and mixing apparatus which requires a minimum of maintenance.

It is a further object of the present invention to provide a concrete measuring and mixing apparatus which is capable of raising the concrete to high discharge level for simplified pouring of walls, etc.

The objects of the present invention are fulfilled by an improved metering slide structure which is hydraulically driven and not subject to binding. The mixing and discharge system of the present invention utilizes an auger for simultaneously mixing the concrete and raising it to a high level suitable for discharge. All of the controls of the present invention, as well as the present invention's drive system, are performed by using a hydraulic system which allows great force to be applied when a part of the machine sticks due to damp concrete and allows simplified control of the moving parts of this apparatus. The hydraulics of the present invention oscillate the metering slide which delivers pre-measured quantities of sand, cement, and gravel to a conveyor which delivers these quantities to a cross-feed auger and then to a final-feed auger which mixes the dry ingredients with water to form the concrete. The final-feed auger feeds the concrete to a location near the top of the mixer and the concrete is dispensed using a concrete pouring chute.

BRIEF DESCRIPTION OF THE DRAWINGS

Other objects of the invention will become more fully understood from the detailed description given herein below and the accompanying drawings which are given by way of illustration only, and thus are not limitative of the present invention, and wherein.

DETAILED DESCRIPTION OF THE PREFERRED EMBODIMENT

Figures 5, 5A, 10:
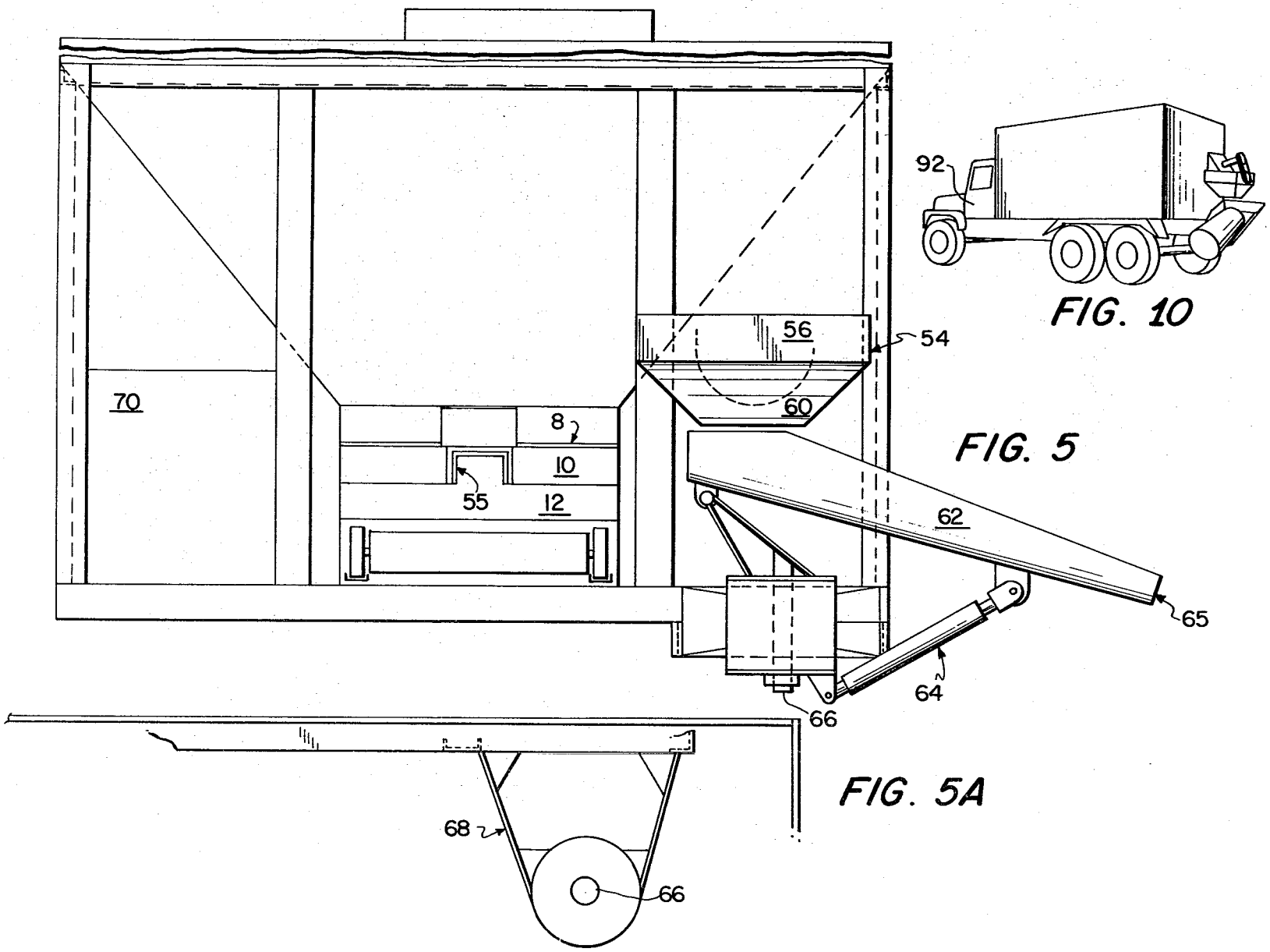
FIG. 5 is a rear elevation of the concrete mixing apparatus of the present invention and FIG. 5A shows a fragmentary top view of the delivery chute mounting pivot shown in FIG. 5.
FIG. 10 shows the concrete mixing apparatus of the present invention mounted on a flat bed truck.

The concrete mixing apparatus of the present invention as disclosed in FIG. 1–9 is designed to be mounted on any suitable, commercially available flat bed truck body 25, as shown in FIG. 10. FIGS. 11–14 show the hydraulic and electric controls of the mixing apparatus of the present invention. Elements appearing in more than one of FIGS. 1–14 are given the same reference numeral in each figure.

Figure 1:
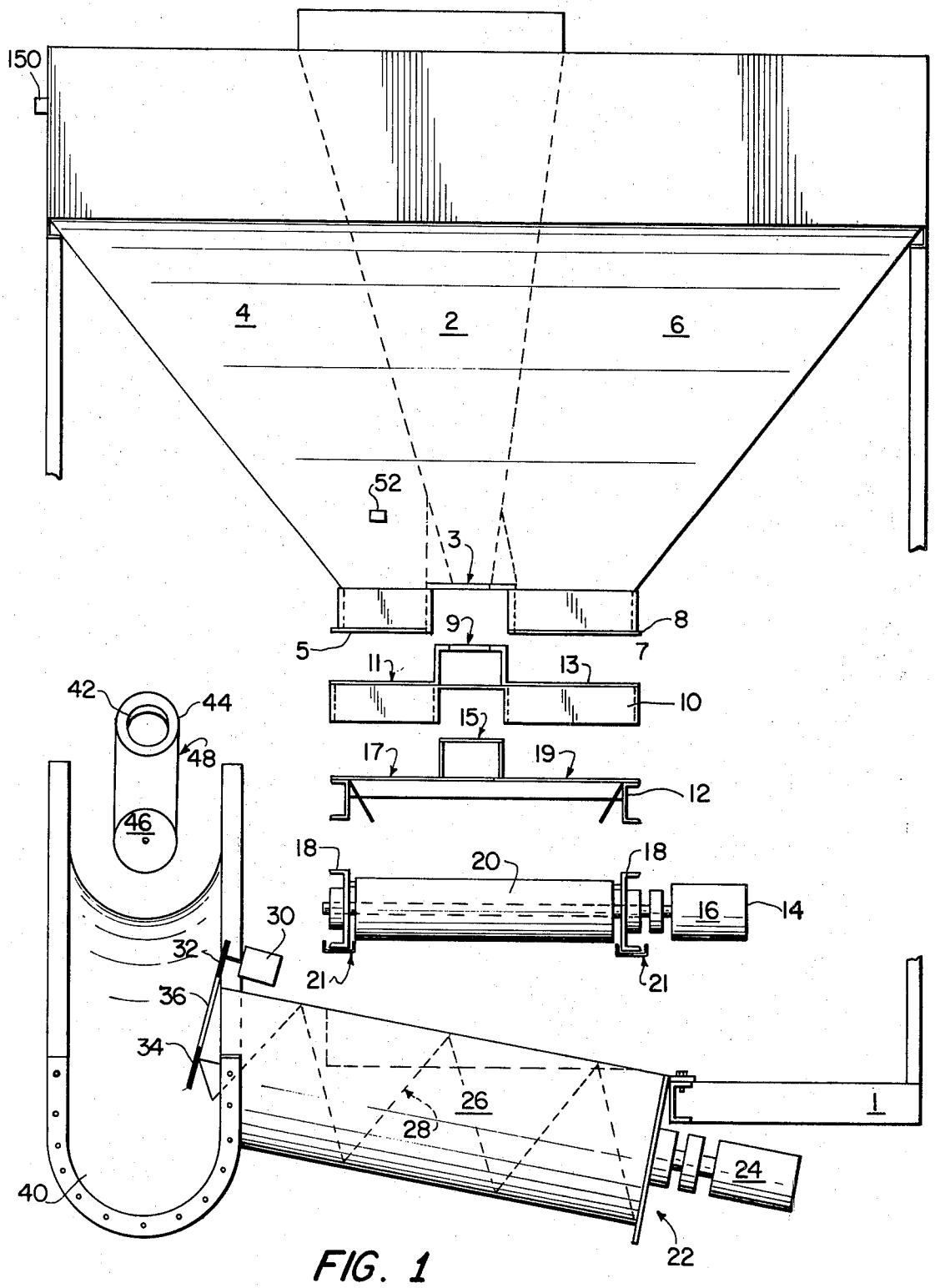
FIG. 1 is an exploded front view of the concrete mixing apparatus of the present invention.

Referring in detail to FIG. 1, there is shown an exploded front view of the concrete mixing apparatus of the present invention. Supported on a suitable mounting frame 1, a plurality of dry material hoppers are shown. A center cement hopper 2 is disposed between a sand hopper 4 and a gravel hopper 6. The gravel hopper 6 is the largest of the three and is disposed on the left side of the mixing apparatus. The cement hopper 2 is the smallest of the three hoppers and is preferably raised from the other hoppers to help isolate it from dampness. The gravel hopper 6 is positioned on the left side of the concrete mixing apparatus of the present invention to increase the stability of a truck carrying the apparatus on a capped road. On a capped road which slopes from left to right, this position of the gravel hopper 6 will allow the center of gravity of the truck to remain closer to the center of the truck's wheel-base.

The hoppers 2,4,6 are mounted to a hopper base 8 including cement ports 3, sand ports 5, and gravel ports 7 which allow these dry materials to be removed through the bottom of the hopper. A metering slide 10 is slidably mounted between the hopper base 8 and a metering slide carrier 12. The metering slide 10 slides on rollers (not shown) mounted to the metering slide carrier 12. The metering slide 10 contains cement chambers 9, sand chambers 11, and gravel chambers 13, each for receiving the respective dry material deposited from the hoppers 2,4,6 through the hopper base 8. The metering slide carrier 12 contains cement ports 15, sand ports 17, and gravel ports 19. These ports allow dry material transferred from the hoppers 2,4,6 to the metering slide 10 to be deposited upon a conveyor assembly 14.

The conveyor assembly 14 includes a hydraulic motor 16 for driving the conveyor belt, frame rails 18 for supporting the conveyor belt, and a conveyor belt 20 which transfers the dry materials deposited from the hoppers 2,4,6 into a cross-feed auger 22. The conveyor assembly 14 is slidably mounted on channels 21 to allow for easy removal to facilitate cleaning.

The cross-feed auger, indicated generally as 22, includes a cross-feed case 26, an auger 28 driven by a lower hydraulic motor 24, and also by an upper hydraulic motor 30 through sprockets 32, 34, and a chain 36. FIG. 1 also shows a final-feed auger case 40 and an upper final-feed hydraulic motor 42 attached to the final-feed drive sprockets 44, 46, and a final-feed drive chain 48. The final-feed auger itself and the lower final-feed hydraulic motor are not shown in this figure.

Also shown in FIG. 1 is an electric vibrator 150 and a pneumatic vibrator 52 disposed on the outside of the sand hopper 4. These vibrators are used to prevent the sand within the hopper 4 from bridging. This is necessary to continuously supply the sand to sand ports 5.

Figure 2:
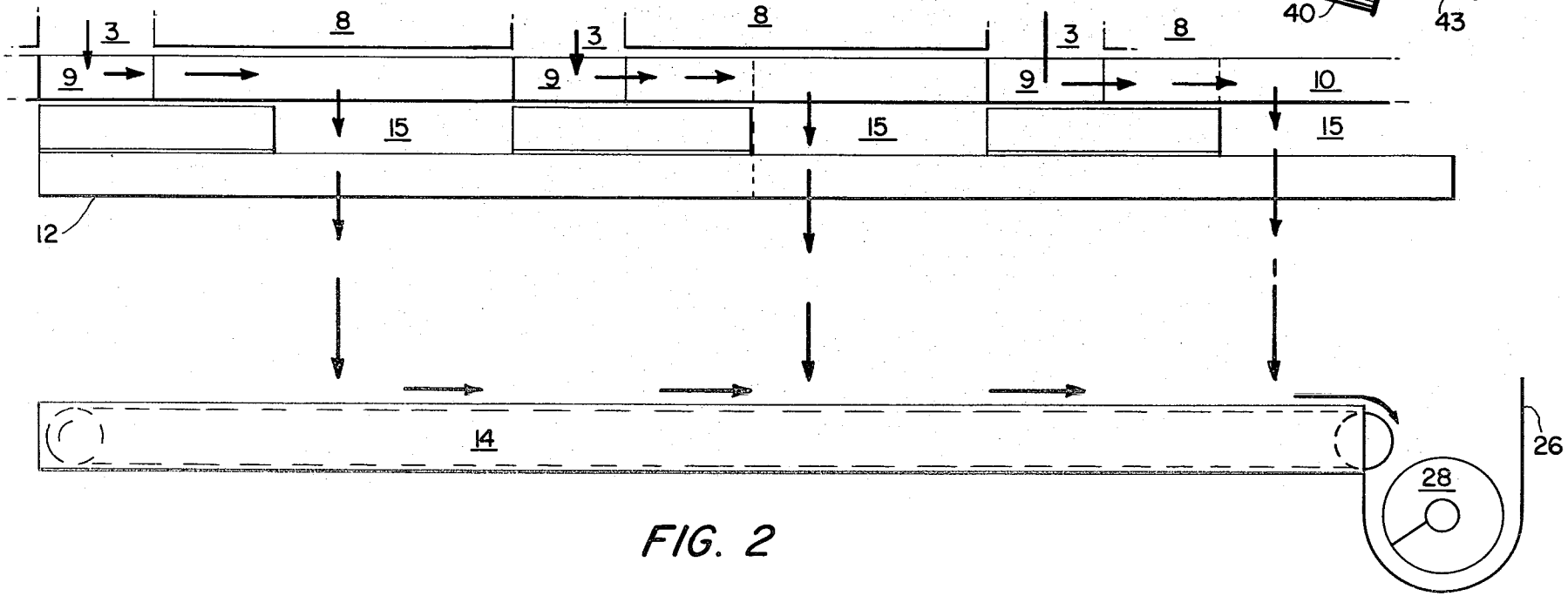
FIG. 2 is a diagrammatic sectional side view of the metering slide assembly and showing the flow of dry materials.

Referring to FIG. 2, the metering slide 10 oscillates from left to right as shown. Cement is presented to the metering slide 10 through the cement ports 3 disposed in the hopper base 8. The cement is received by the cement chambers 9 of the metering slide 10 while these chambers 9 are located under the cement ports 3. The metering slide 10 oscillates to the right and when the cement chambers 9 are disposed over the cement ports 15 within the metering slide carrier 12, the cement disposed within the cement chambers 9 falls onto the conveyor assembly 14 which transmits the cement to the cross-feed auger 28 disposed within the cross-feed auger case 26. The metering slide 10 then oscillates to the left to receive another batch of cement through the cement ports 3 within the hopper base 8. While FIG. 2 only shows metering of cement from the cement hopper 2 by metering slide 10, the gravel and sand are metered simultaneously from the gravel and sand hoppers 6 and 4, respectively, in the same manner.

Figure 3:
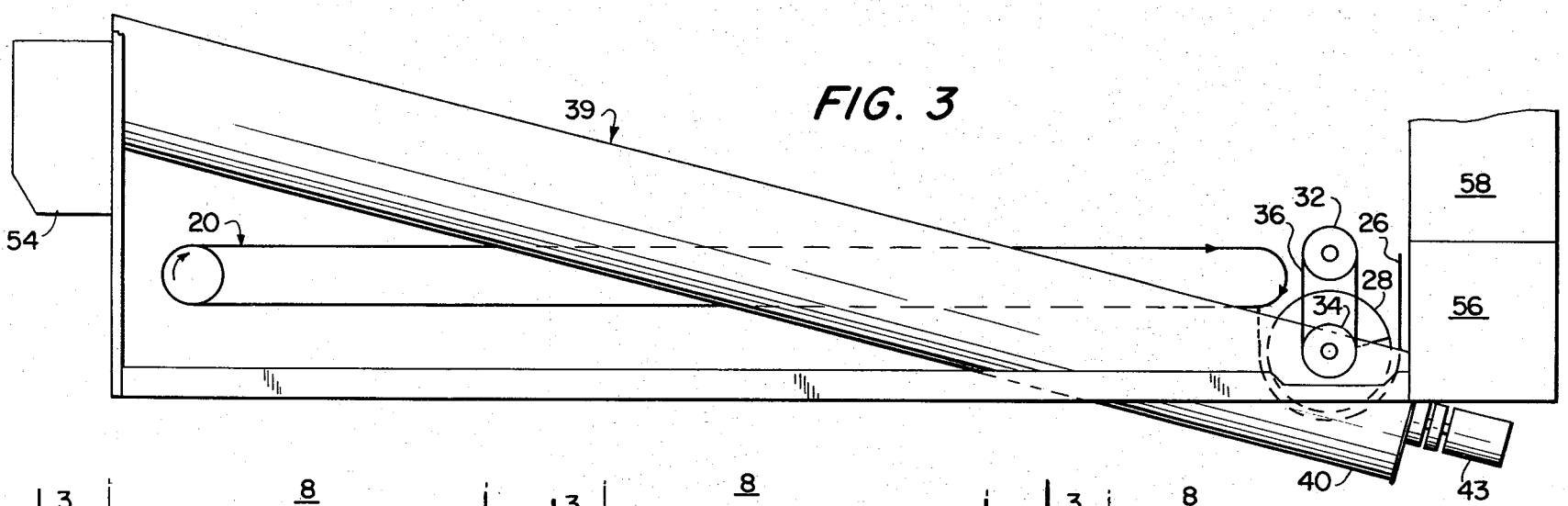
FIG. 3 is a partial side view of the concrete mixing apparatus of the present invention showing the relationship of the conveyor, cross-feed auger, and final-feed auger.
Figure 4:
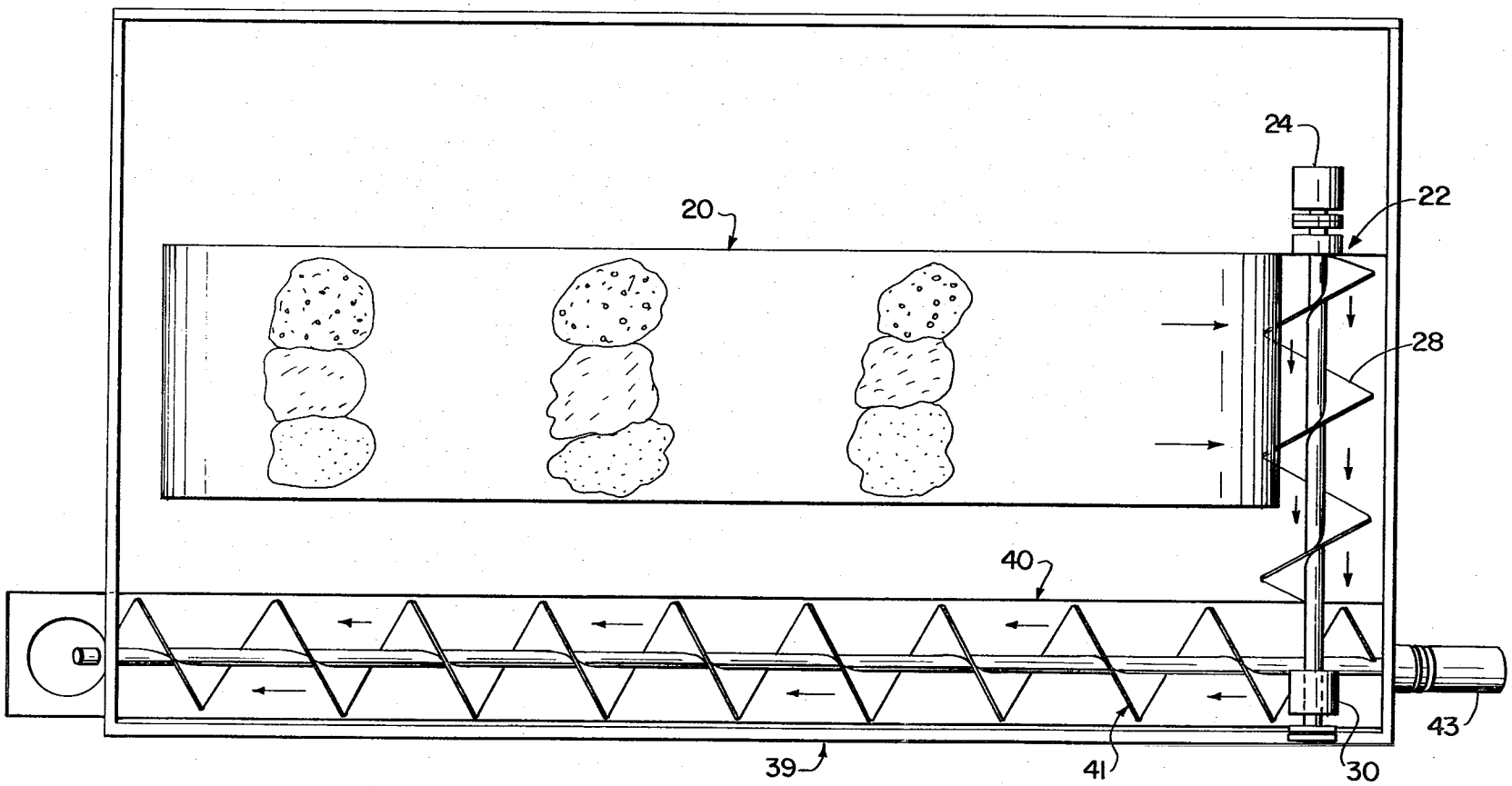
FIG. 4 is a partial top view of parts of the concrete mixing apparatus shown in FIG. 3.

In FIG. 3 a right side view of the mixing apparatus of the present invention particularly discloses the details of the final-feed auger assembly generally indicated as 39. This figure shows the final-feed auger case 40, a lower final-feed auger hydraulic motor 43 and a collector receptacle 54. The final-feed auger itself is shown in FIG. 4 and the upper final-feed hydraulic motor 42 is shown in FIG. 1. FIG. 3 also shows the hydraulic fluid tank 56 and the water tank 58, both located at the front of the concrete mixing apparatus. FIG. 4 is a fragmentary top view of the concrete mixing apparatus showing the flow of dry materials from conveyor belt 20 to cross-feed auger assembly 22 to final-feed auger assembly 39.

As shown in FIG. 1–4, the dry materials are deposited from the metering slide 10 onto the conveyor assembly 14 which transfers the dry material along the metering slide's direction of oscillation toward the front of the concrete mixing apparatus. The dry materials are dropped off the end of the conveyor belt 20 and fall into the cross-feed auger 28 which extends under the end of the conveyor assembly 14 transverse to its direction of travel. Cross-feed auger 28 transmits the dry materials to the end of the cross-feed auger positioned over an opening in the case 40 of the final-feed auger assembly 39. The dry materials fall into this opening in the final-feed auger case 40 where they are mixed with water to form concrete. The final-feed auger assembly 39 moves the resulting concrete to a top rear corner of the concrete mixing apparatus as it mixes it. The final-feed auger assembly moves the resulting concrete in a direction opposite to the direction of travel of the conveyor belt 20 and simultaneously raises the resulting concrete to a relatively high position on the rear of the concrete mixing apparatus. When the concrete reaches the end of the final-feed auger near this top rear corner of the mixing apparatus, the concrete is dumped into the collector receptacle 54. The final disposition of the concrete deposited in collector receptacle 54 will be explained later in connection with FIGS. 5 and 5A.

The final-feed auger assembly 39 includes a final-feed auger 41 housed in the case 40 and driven by the lower final-feed hydraulic motor 43 and also driven by the upper final-feed hydraulic motor 42 which drives the final-feed auger 41 as explained in connection with FIG. 1.

Referring to FIGS. 5 and 5A, the details of rear portion of the cement mixing apparatus of the present invention are shown including the concrete collector receptacle 54, which includes a collector ring 56 for receiving the concrete emitted from final-feed auger assembly 39 and a funnel 60 for directing the concrete to a delivery chute 62. The delivery chute 62 rotates about a pivot 66 which is mounted on a bracket 68 as shown in FIG. 5A. The height of the chute outlet 65 is determined by adjustment of a chute adjustment hydraulic cylinder 64. Control panel 70 is located in the lower left portion of rear of the concrete mixing apparatus of the present invention.

Figure 6:
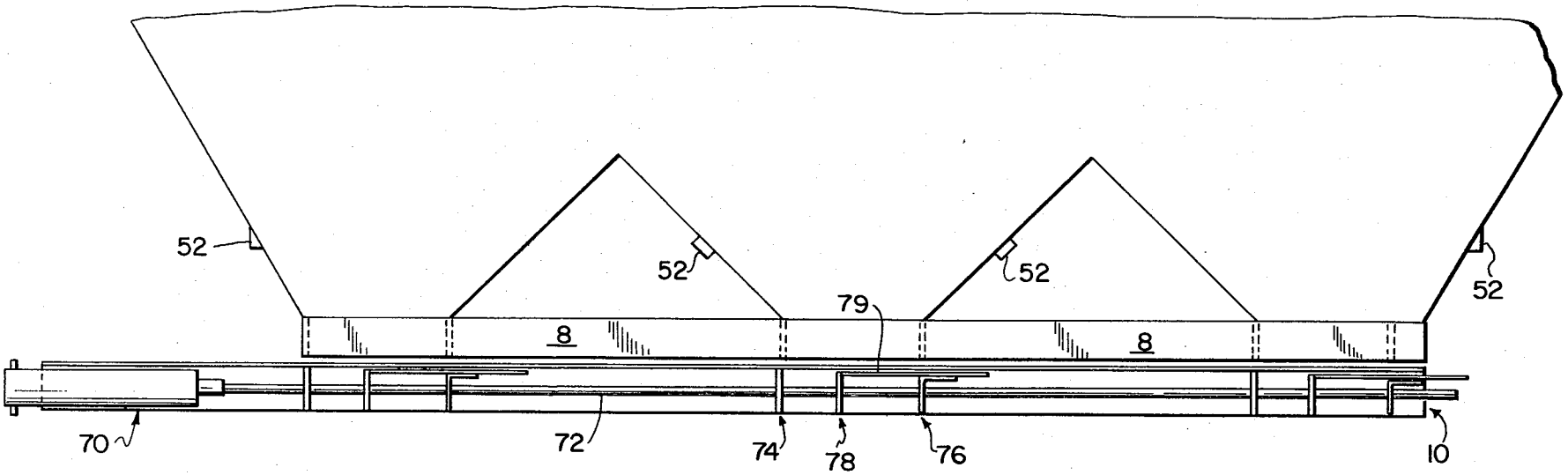
FIG. 6 is a sectional side elevation of the metering slide chamber adjusting system of the present invention taken along line B—B of FIG. 1.

In FIG. 6, a system for adjusting the size of dry material chambers 9, 11, and 13 is shown. This system is mounted on the metering slide. While only the sand chamber adjustment system is shown in FIG. 6, the cement and gravel chambers have similar adjusting systems. The volume of these chambers, as exemplified by the sand chamber 11, may be adjusted by means of an adjustable front wall 78 which together with two fixed side walls (not shown) and a fixed rear wall 74 define the rectangular volume of the exemplary sand chamber 11. This volume is adjusted through the use of a hydraulic adjustment cylinder 70, the control of which will hereinafter be more fully described. Hydraulic adjustment cylinder 70 pushes or pulls a shaft 72 fixed to the adjustable front wall 78 to adjust the position of this wall 78 in relation to the fixed rear wall 74 and a support wall 76, each of which provides a bearing support which allows free movement of the shaft 72. A paddle 79 attached to the adjustable front wall 78 prevents the dry material from dropping between the adjustable front wall 78 and the support wall 76. This paddle also allows the dry material to be completely shut off. This is a useful feature which allows the same concrete mixing apparatus to be used to mix other materials. For example, stucco may be produced by shutting off gravel chambers 13. Also shown in FIG. 6 is the placement of four pneumatic sand vibrators 52 as described in connection with FIG. 1. These pneumatic sand vibrators 52 are fixed to the outside surface of any of the walls of the sand compartment 4 which extend across the shortest dimension of the sand compartment 4. In the preferred embodiment which has three sand ports 5 which release sand from three sections of sand compartment 4, there are four pneumatic sand vibrators 52, each having a mounted height of approximately one-third the distance from the bottom to the top of the hopper. One pneumatic vibrator 52 is mounted in the horizontal center of each of the short walls of the center hopper section and one pneumatic vibrator is mounted in the center of each outermost end of the sand hopper 4.

Figure 7:
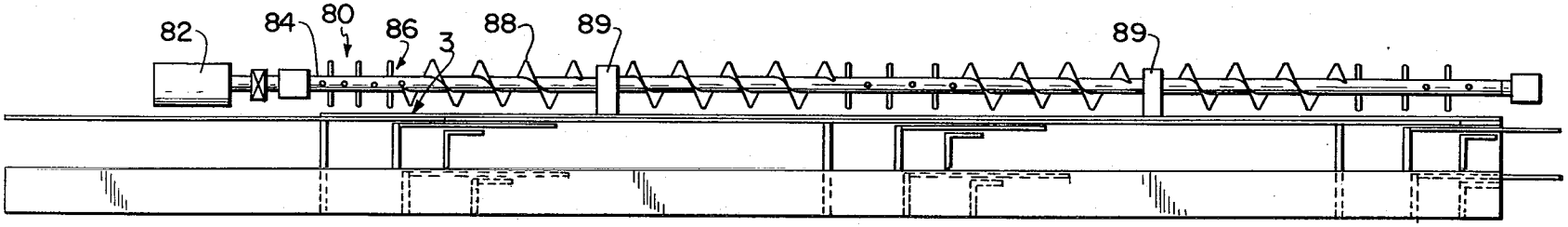
FIG. 7 is a sectional side elevation of the cement freeing assembly of the present invention.

Referring to FIG. 7, a cement freeing assembly 80 is shown including break up tines 86 and cement feed augers 88. This cement freeing assembly is positioned near the bottom of the cement hopper 2 on its centerline. Cement hopper 2 has a planar bottom surface which differs from the bottom surfaces of the sand and gravel hoppers 4,6 which have steeply sloping center dividers to direct the sand and gravel to the sand and gravel ports 5, 7. Consequently, the cement feed augers 88 of the cement freeing assembly are necessary to direct the cement over the cement ports 3. The break up tines 86 are positioned directly over cement ports 3 and are used to insure that clumps of cement are broken up before they exit the cement hopper 2. The cement feed augers 88 and the break up tines 86 are rotated by a freeing assembly shaft 84 which is driven by a freeing assembly hydraulic motor 82 which is positioned outside the cement hopper 2. The freeing assembly shaft 84 rotates on bearing blocks 89 which are located midway between the cement ports 3.

Figure 8:
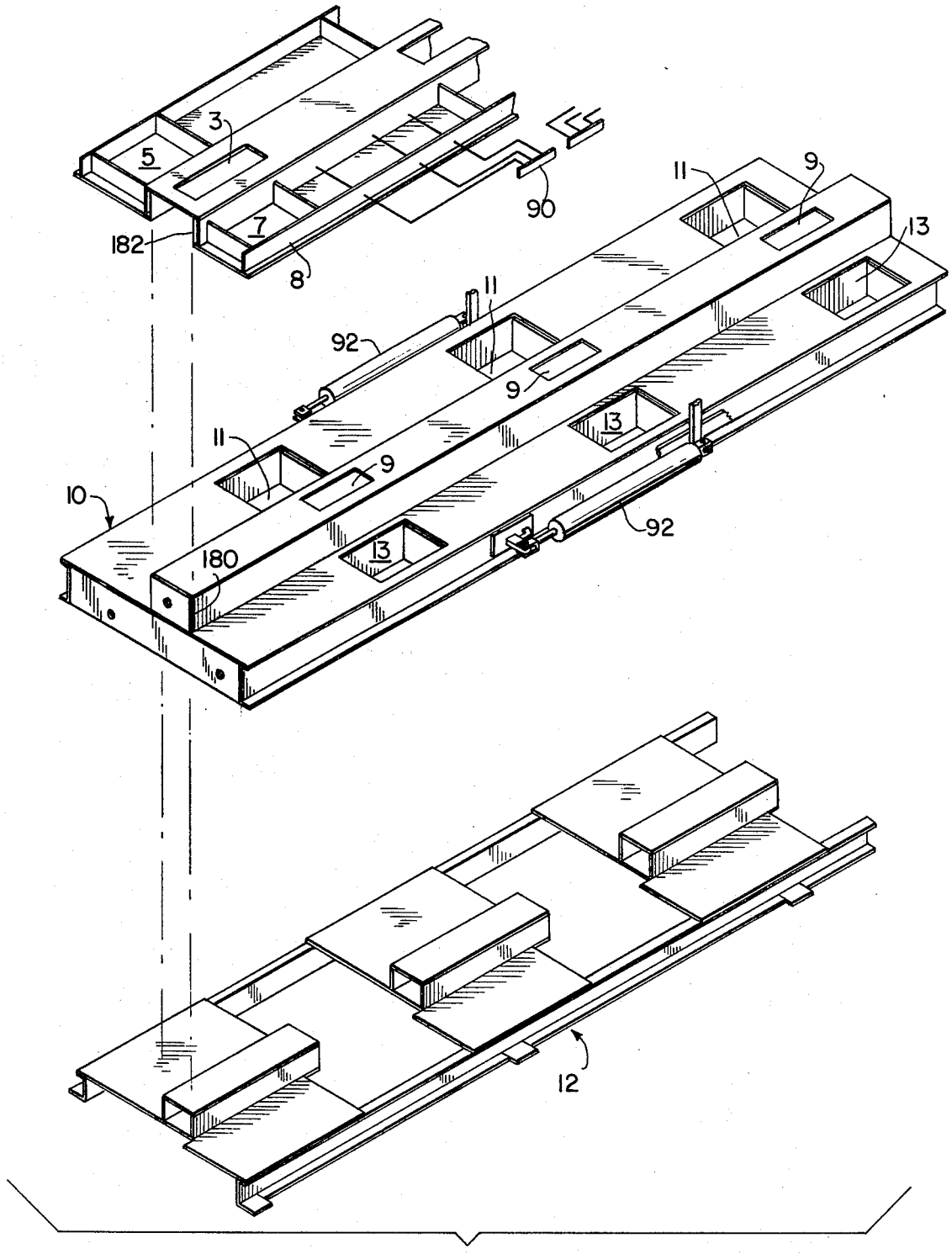
FIG. 8 is an exploded view of the metering slide assembly of the present invention.

Referring to FIG. 8, the exploded view of the metering slide 10, the metering slide carrier 12, and the hopper base 8 shows how the metering slide 10 is greased to prevent moisture from reaching the cement hopper 2. A set of grease fittings 90 allow grease to be applied between an outside surface 180 of the raised cement portion of the metering slide 10 and a pair of inside surface 182 of the channel formed in the bin base 8. This grease lubricates the metering slide 10 and forms a moisture barrier to help prevent the cement from becoming damp and sticking inside the cement hopper 2. Two metering slide oscillation hydraulic cylinders 92 are mounted to the side of the metering slide 10. The details of this mounting will be more completely explained with reference to FIGS. 9A, 9B.

Figure 9A:
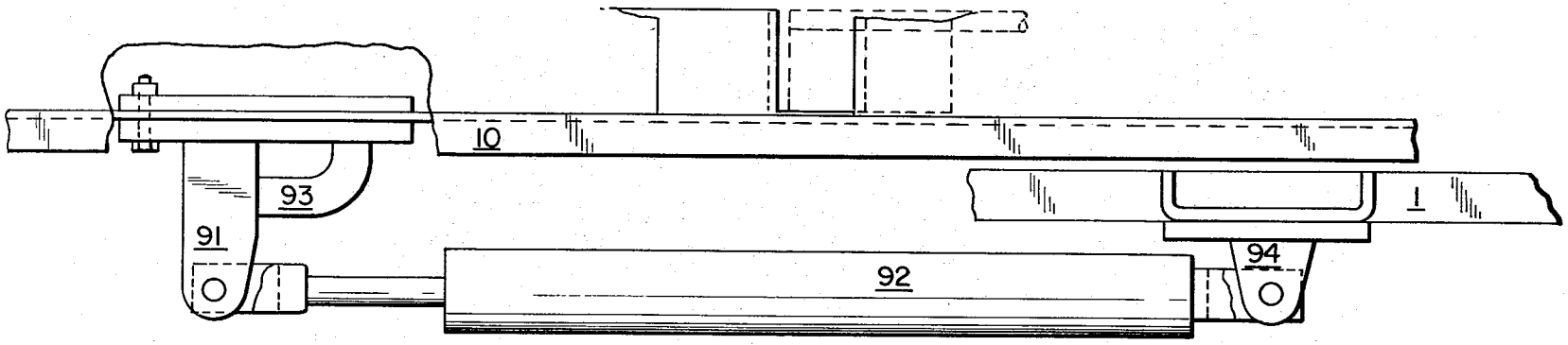
FIGS. 9A and 9B are fragmentary top and side views of the metering slide oscillation cylinder of the present invention.
Figure 9B:
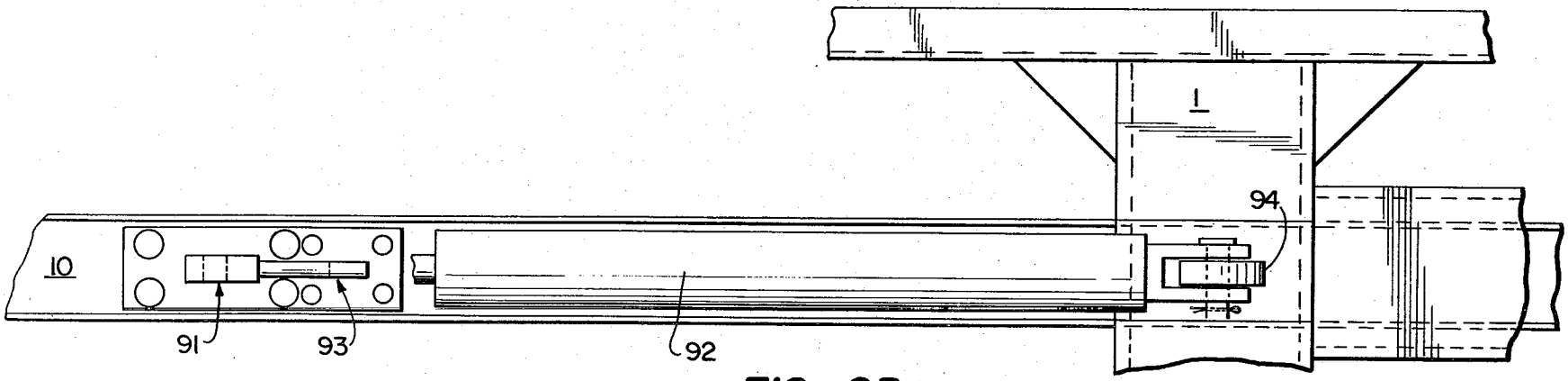

Details of the mounting of the metering slide oscillation hydraulic cylinder 92 on the concrete mixing apparatus will now be described with reference to FIGS. 9A and 9B. At a first end of the oscillation hydraulic cylinder 92, a bracket 94 is welded to the frame 1. A second end of the oscillation hydraulic cylinder 92 is connected to a bracket 91 bolted to the center of the side of the metering slide 10. The bracket 91 is strengthened through the use of a supplemental bracket 93 which is shaped in the form of an arc and is fastened to the metering slide at one end and to the outside end of the bracket 91 at the arc's other end. This bracket distributes the force exerted by the oscillation hydraulic cylinder 92. Two oscillation hydraulic cylinders 92 are used on the concrete mixing apparatus of the present invention. These oscillation hydraulic cylinders 92 develop great forces which help to overcome any sticking of the metering slide 10. One of the oscillation hydraulic cylinders 92 is mounted on each side of the metering slide 10 as shown in FIG. 8.

FIG. 10 shows the concrete mixing apparatus of the present invention mounted on a conventional flatbed-type truck 25.

Figure 11:
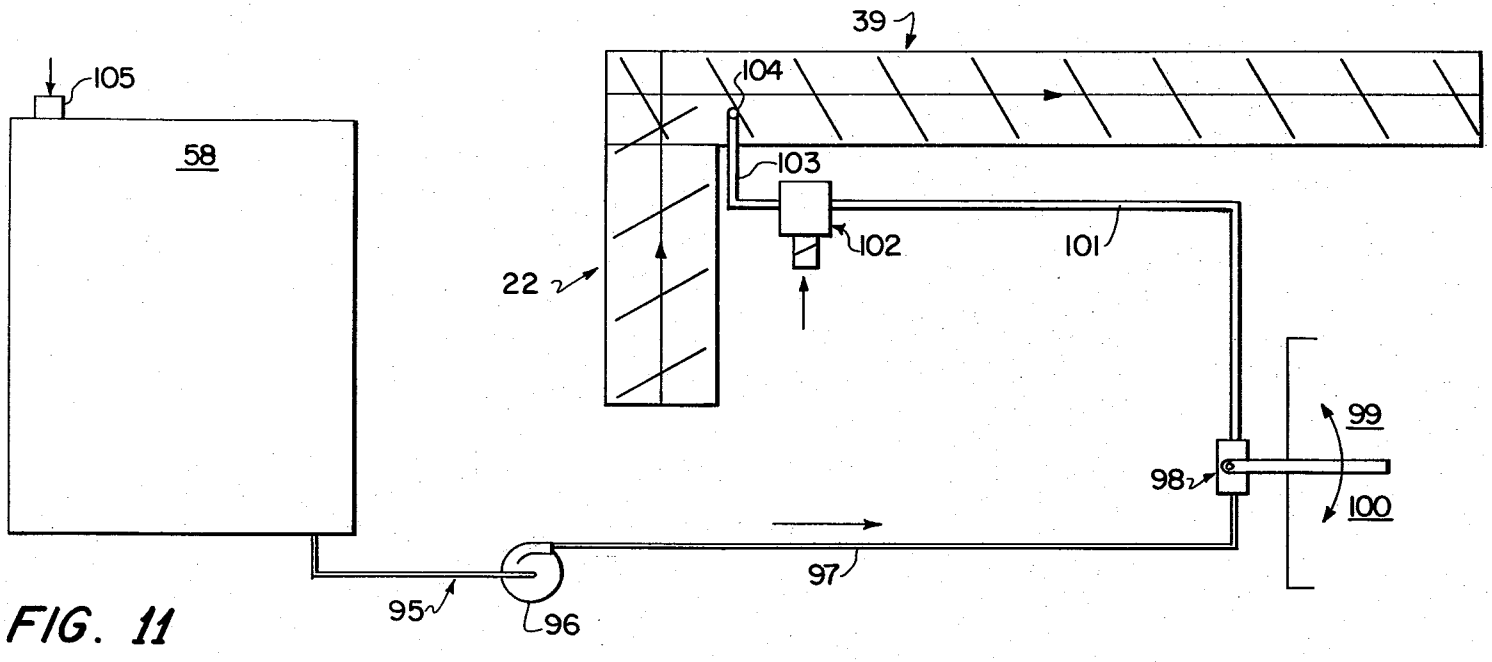
FIG. 11 shows the water supply system of the present invention.

The controls used in the present invention will now be described with reference to FIGS. 11–14. The water system of the present invention is shown in FIG. 11 as including a water supply tank 58 having a fill port 105 and an outlet pipe 95 through which water is supplied to a water pump 96. The water pump 96 is driven by a hydraulic motor 115 and pumps water through a line 97 to an adjustable manual control valve 98 having an open position 99 and a closed position 100. When the manual control valve 98 is open, the pump 96 supplies water along a line 101 to an electrically operable solenoid valve 102. When this solenoid valve 102 is open, water is supplied through a line 103 into the final-feed auger assembly 39 through an opening 104. The amount of water flowing into the final-feed auger assembly 39 is controlled through the use of the hydraulic control shown in FIG. 12.

Figure 12:
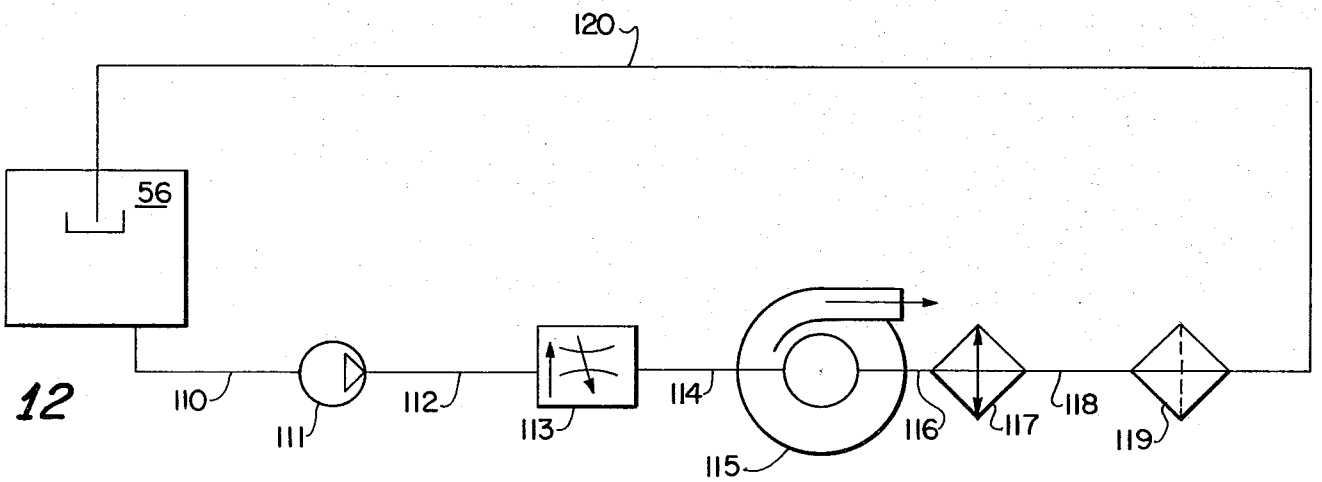
FIG. 12 is a partial hydraulic control circuit showing the details of the hydraulic circuit of FIG. 13 which effect the water supply system of FIG. 11.

The hydraulic system illustrated in FIG. 12 is a simplified version of a more detailed hydraulic control to be described with reference to FIG. 13 and like parts are identified with like numerals. This control system includes a hydraulic tank 56 which supplies hydraulic fluid to hydraulic pump 111 through a line 110. The output of the hydraulic pump 111 is supplied to a variable control compensated flow control valve 113 via a line 112. The flow control valve 113 controls the speed of the pump 96 to thereby control the amount of water pumped into the final-feed auger assembly 39. The hydraulic fluid from the flow control valve 113 is supplied to a hydraulic motor 115 via a line 114. The output shaft of the hydraulic motor 115 is directly connected to the input shaft of the pump 96. The output of the hydraulic motor 115 is applied to a cooler 117 via a line 116. The output of the cooler 117 is supplied to a return line filter 119 via a line 118. The output of the return line filter 119 is returned to the hydraulic tank via a return line 120.

The hydraulic controls of the present invention will now be further described with reference to FIG. 13. Hydraulic fluid from the hydraulic tank 56 is drawn by a pump 124, which includes the pump 111 and which supplies the fluid to three fluid lines 126, 132, and 110.

The fluid from one line 126 is applied to a first parallel hydraulic circuit through a compensated conveyor speed control valve 127, a line 128, a conveyor drive motor 16, and a line 129 to an intermediate return manifold 156. From the intermediate return manifold 156 the fluid flows to a radiator 156 through a line 158 and then through a line 159 to a return manifold 155. The return manifold 155 then supplies fluid to a return line filter 119 connected to the hydraulic tank 56. Another parallel branch of the one fluid line 126 includes the final-feed auger speed control valve 130, a line 131, the auger hydraulic motors 42 and 43, and return lines 132 and 133 which return the hydraulic fluid to the intermediate return manifold 156.

Another parallel branch of the one fluid line 126 includes a cross-feed auger speed control valve 134, a line 135, the hydraulic auger drive motors 24 and 30, and lines 136 and 137 which return the hydraulic fluid to the intermediate return manifold 156. Also connected to the one fluid line 126 is a relief valve 138 connected to a line 139 which is connected to the return manifold 155. The relief valve 138 in the preferred embodiment is set to vent the one fluid line 126 at a pressure of 2,750 p.s.i.

A second fluid line 132 emanating from the pump 125 is connected to the series connection of the cement auger speed control valve 142, a line 143, the cement auger hydraulic drive motor 82, and a line 144 which returns the hydraulic fluid to the intermediate return manifold 156.

The metering slide drive cylinders 92 are driven from the pump 125 through the series connection of the second fluid line 132, 4-way directional control valve 145, and lines 146 and 147. The hydraulic fluid is returned from the 4-way directional control valve 145 to the return manifold 155 via line 148. The 4-way directional control valve 145 is designed to oscillate the metering slide drive cylinders 92 at a maximum speed of approximately 16 strokes per minute.

The second fluid line 132 also supplies fluid to a pressure relief valve 149 which is connected to the return manifold 155 via a line 150. The relief valve 149 is set to vent the second fluid line 132 of hydraulic pressures over 2,750 p.s.i. The output of the second fluid line 132 is also supplied to a master speed control valve 151 which bleeds hydraulic fluid to the return manifold 155 via a line 152. This master speed control valve 151 controls the hydraulic pressure used to drive the metering slide cylinders 92 to thereby vary their rate of oscillation.

The output of a third fluid line 110 is connected to the input of a directional flow control valve 153 which controls the extension of the chute cylinder 64. Fluid is bled off from chute control 153 via a line 154 to the intermediate return manifold 156. Also connected to the third fluid line 110 is the water speed control valve 113, the line 114, the water pump drive hydraulic motor 115, and the line 114 connected to the intermediate return manifold 156 for return to the hydraulic fluid tank 54.

Figure 14:
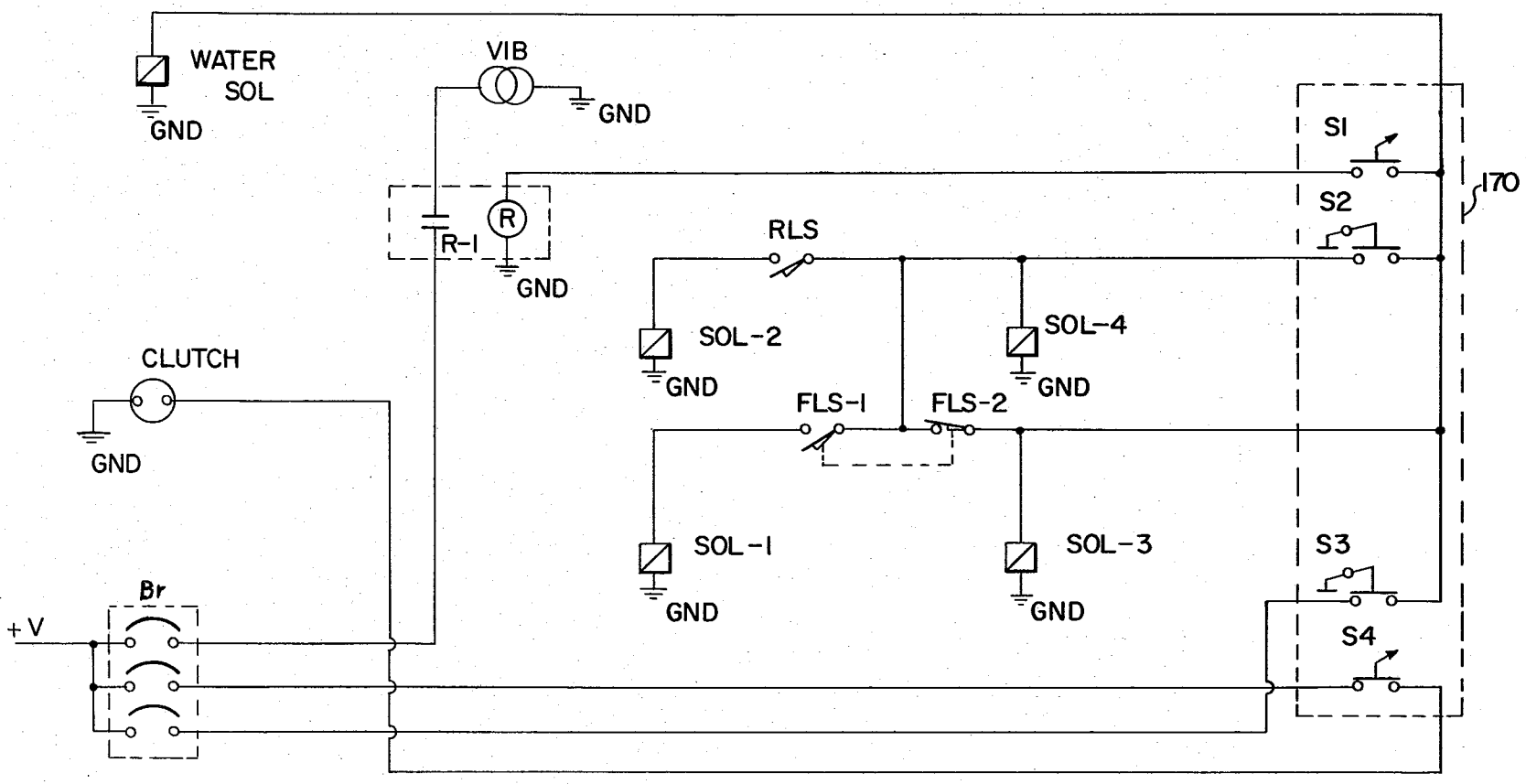
FIG. 14 shows the electrical control system for the present invention.

FIG. 14 discloses the electrical control circuit of the present invention. Switches S-1 through S-4 are arranged in an electrical control block 170 disposed within the control panel 70. First switch S-1 on the electrical control block 170 is a vibrator on/off switch which controls a relay R which closes a normally open contact pair R-1 to connect the vibrator VIB between a positive voltage +V and a ground GND via a circuit breaker BR.

An on/off clutch switch S-4 applies the power to the clutch CLUTCH to engage or disengage the hydraulic pumps to turn on and off the hydraulic controls of the present invention. An auger on/off switch S-3 when turned on, energizes auger relief valve solenoid SOL-3 to energize the auger. Simultaneously, a water valve solenoid WATER-SOL which drives valve 102 is energized to enable the water supply system of FIG. 11. The auger on/off switch S-3 also applies power to a terminal of the slide on/off switch S-2. When a slide on/off switch S-2 is closed, a slide relief valve solenoid SOL-4 connects the slide oscillation hydraulic cylinders 92 to the hydraulic circuit. The metering slide 10 always comes to rest in its forwardmost position with a front limit switch FLS-1 closed. The slide directional control valve SOL-1 is turned on to drive the metering slide 10 in a first direction. When the metering slide 10 reaches the end of its travel in the first direction, a front limit switch FLS-1 opens and a rear limit switch RLS closes. This de-energizes the hydraulic pressure applied to the first side of each slide oscillation hydraulic cylinder 92 by 4-way valve 145 and switches valve 145 to apply hydraulic pressure to the second side of the slide oscillaiton hydraulic cylinders 92 to reverse the direction of the metering slide. When the metering slide 10 approaches its resting position the front limit switch FLS-1 again closes and the rear limit switch RLS opens to again reverse the direction of the metering slide 10. Thus, the metering slide 10 oscillates back and forth until slide on/off switch S-2 is disconnected. The front limit switch FLS-1 has a second pair of contacts FLS-2. These contacts FLS-2 are used to ensure that when slide on/off switch is disconnected, the metering slide 10 will always come to rest in its forwardmost position.

DESCRIPTION OF OPERATION

To commence operation, the operator turns on clutch on/off switch S-4 to close its contacts and to connect pump 125 to the power take-off (not shown) of truck 25. This energizes the hydraulic controls of FIG. 13. The operator then turns on auger on/off switch S-3 to start the rotation of the cement, cross-feed, and final-feed augers 28, 41, and 88. The operator then closes slide on/off switch S-2 to begin the oscillation of the metering slide 10.

As best shown in FIG. 2 the metering slide oscillates back and forth to move the metering slide chambers 9, 11, 13 between the dry material ports 3, 5, 7 in the hopper base 8 and the dry material ports 15, 17, 19 in the metering slide carrier 12. In the case of FIG. 2, the cement chambers 9 are oscillated between the hopper cement ports 3 and the metering slide carrier cement ports 15. The metering slide oscillates so that the cement chambers 9 are positioned under the hopper cement port 3 to fill cement chambers 9. The metering slide 10 then moves until the cement chambers 9 are positioned over the metering slide carrier cement port 15. The cement then falls onto the conveyor belt 20. Simultaneously, similarly situated hopper base ports 5, 7 deposit sand and gravel into sand and gravel chambers 11, 15 in the metering slide. When the metering slide moves over the metering slide carrier ports 17 and 19 for sand and gravel, the sand and gravel drop onto the conveyor belt 20.

As shown in FIG. 4, the sand, gravel, and cement are carried by the conveyor 20 to the cross-feed auger assembly 22. Cross-feed auger 28 moves the dry materials into the final-feed auger case 40. The final-feed auger 41 simultaneously raises the dry materials and mixes them with water entering the final-feed auger case 40 through the opening 104 as shown in FIG. 11. This final-feed auger assembly 39 mixes the dry materials and water together to form the fnal concrete mixture.

This final concrete mixture is poured into the concrete collector receptacle 54 which includes the collector ring 56 and the funnel 60. The funnel 60 of the concrete collector receptacle 54 channels the concrete onto the chute 62 which deposits the concrete where the chute is directed. Thus, the concrete mixer of the present invention allows the dry materials to be transported to where they are needed and mixed at the site.

The sand hopper 4 of the present invention has an electric vibrator 50 and four pneumatic vibrators 52 mounted thereon. These vibrate the sand hopper 5 to prevent the sand from bridging. This is done to insure a continuous supply of sand to conveyor belt 20. The continuous transfer of cement from the hopper 2 to the metering slide 10 is accomplished by the use of the auger assembly 80 including the feed screws 88 and the tines 86 as shown in FIG. 7. The combination of feed screws and tines allows the cement to be moved to a position over the hopper base cement ports and also breaks up any cement clods.

FIG. 6 shows the dry materials adjustment system of the present invention. The metering slide of the present invention includes an adjustment assembly for the metering slide chamber associated with each of the cement, sand, and gravel hoppers 2, 4, 6. A hydraulic cylinder 70 actuates shaft 72 to vary the position of each adjustable front wall 78. A paddle 79 is attached to each adjustable front wall 78 and serves to prevent the dry material from falling into the space between the adjustable front wall 78 and the fixed wall 76. Dry material collecting behind the adjustable front wall 78 would prevent the adjustable front wall 78 from opening to thereby impede the adjustment operation. The adjustable front wall 78 may be closed completely to allow the concrete mixing apparatus of the present invention to be used for mixing mortar or stucco, for example.

FIG. 8 shows an exploded view of the metering slide assembly of the present invention. An important feature of the present invention resides in the raising of the cement hopper ports 3 of the metering slide above the level of the sand and gravel hopper ports 5,7. Because sand and gravel have a tendency to absorb moisture, the cement is raised to a height above them to reduce the possibility of moisture reaching the cement. Also, the outside surfaces of the concrete section sides 180 of metering slide 10 and the inside surfaces of the cement channel 182 formed in the hopper base 8 form a relatively narrow space which is filled with grease through the use of a set of grease fittings 9. This grease filled space prevents moisture from being drawn into the cement hopper 2, to thereby prevent it from becoming damp and setting. Moisture prevention is important in the mixing apparatus of the present invention since the cement will often remain stored in the cement hopper 2. If the cement sets while in the cement hopper 2 then the operation of the mixing apparatus of the present invention would be severely affected. In the present invention, however, the cement remains dry.

Figure 13:
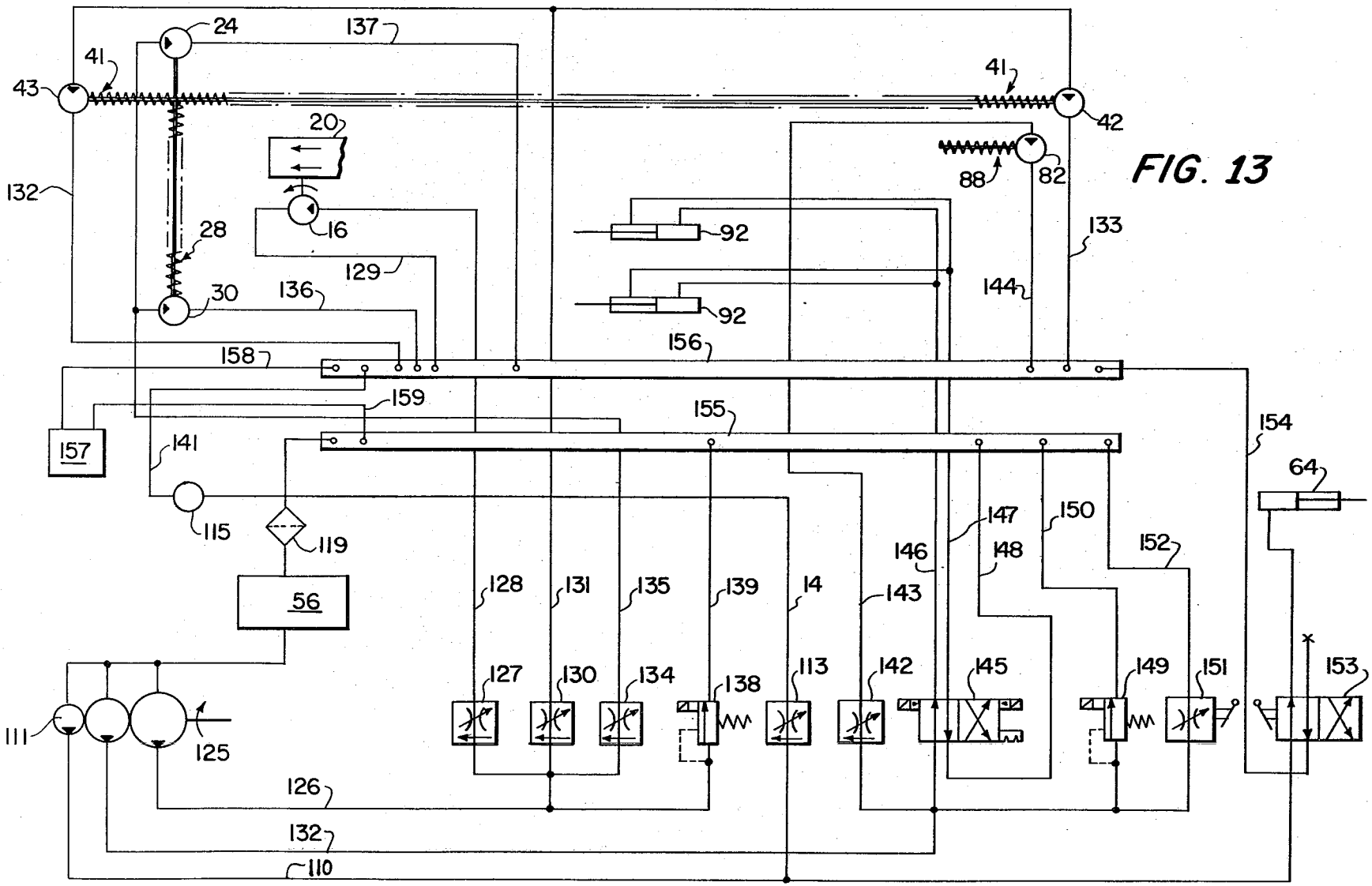
FIG. 13 is the hydraulic control system of the present invention.

The hydraulic cylinder of FIG. 9 is driven by the hydraulic control circuit of FIG. 13. A 4-way directional control valve 145 operated in conjunction with the RLS and FLS limit switches and the SOL-1 and SOL-2 solenoids oscillates the metering slide 10 through application of hydraulic force within the hydraulic cylinders 92. When the metering slide is disposed at the front of its travel, the front limit switch FLS-1 is closed to close the slide directional control valve solenoid SOL-1 which causes the 4-way directional control valve 145 to apply hydraulic force to the metering slide 10 through the hydraulic cylinder 92 and move the metering slide 10 towards the rear of the mixing apparatus. This opens front limit switch FLS-1. When the metering slide 10 reaches the rear of the mixing apparatus, the rear limit switch RLS is closed to thereby activate the slide directional control valve 145 to apply hydraulic pressure within the hydraulic cylinders 92 to move the metering slide 10 to the front of the mixing apparatus. When the slide on/off switch S-2 is turned off, opening contacts S-2, the FLS-2 limit switch contacts continue to apply power to SOL-2 if the metering slide 10 is in its rearmost position with limit switch RLS closed. Thus, the metering slide 10 moves to its forward most position where it will stop since the second front limit switch contacts FLS-2 are open. Therefore, metering slide 10 always terminates its travel at the front of the mixing apparatus.

FIG. 13 is a hydraulic control schematic for the mixing apparatus fo the present invention. Valves 127, 130, 134, 113, and 142 control the speed of the hydraulic motors driving the conveyor 20, the cross-feed auger 28, the final-feed auger 41, the cement hopper auger 88, and the water pump 96. Thus, the speed of each of these elements may be varied individually. Also, the speed of the metering slide may be varied by use of the master speed control valve 151 which bleeds hydraulic pressure off of the 4-way directional control valve 145 to thereby decrease the speed of oscillation of the metering slide hydraulic cylinders 92. This simultaneously reduces the pressure applied to water pump motor 115 to reduce the amount of water supplied to the final-feed auger 41, thereby keeping the consistency of the concrete constant.

The water supply system shown in FIG. 11 includes the pump 96 driven by the hydraulic motor 115 and velocity controlled by flow control valve 113. This flow control valve 113 in conjunction with the variable manual control valve 89 regulates the amount of water supplied to the cross-feed conveyor assembly 39 for mixture with the dry materials. The solenoid valve 102 is also disposed within the water supply line. This solenoid valve 102 is controlled by activation of auger on switch S-3 as shown in FIG. 14. Thus, the augers must be rotating in order to supply water to the final-feed auger assembly 39.

It should be understood that the system described herein may be modified as would occur to one of ordinary skill in the art without departing from spirit and scope of the present invention.

What is claimed:

1. A device for mixing measure amounts of concrete from fluid and dry ingredients including cement, comprising:

a frame;

a plurality of hoppers for storing said dry ingredients mounted on said frame, said plurality of hoppers including a cement hopper;

a tank for storing said fluid mounted on said frame;

a metering slide assembly having a slide with a plurality of compartment-like metering slide chambers, said metering slide oscillating from a first position for receiving into said chambers a predetermined amount of dry ingredients from said hoppers to a second position for discharging said predetermined amounts of dry ingredients;

mixing and moving means for mixing the dry ingredients with said fluid and dispensing the resultant concrete in the desired location; and hydraulic drive and control means for driving said metering slide assembly and said mixing and moving means and for controlling the consistency and amount of concrete dispensed, said drive and control means being capable of overcoming binding resulting from set up of said concrete or dry ingredient;

said cement hopper being raised above the level of the other of said plurality of hoppers;

said metering slide assembly further including a grease barrier disposed between said metering slide and said cement hopper, said grease barrier preventing moisture from reaching said cement hopper.

2. The device of claim 1 wherein said mixing and moving means includes, a conveyor for receiving the dry ingredients from said metering slide assembly, and a final-feed auger which mixes said dry ingredients received from said conveyor with said fluid to form concrete.

3. The device of claim 2 wherein said final-feed auger raises said concrete to a point relatively near the top of said device while mixing.

4. The device of claim 3 wherein said mixing and moving means further includes a cross-feed auger which receives said dry materials from said conveyor and deposits them in said final-feed auger.

5. The device of claim 4 wherein said mixing and moving means further includes chute means for receiving material from said final-feed auger and directing said concrete to the desired location.

6. The device of claim 2 wherein said conveyor is slidably mounted on said frame to allow easy removal and cleaning.

7. The device of claim 1 wherein the size of said metering slide chambers are adjustable to vary the predetermined amount of each of the dry ingredients.

8. The device of claim 7 wherein at least two different dry ingredients are used; and wherein the predetermined amount of each dry ingredient is independently variable.

9. The device of claim 8 wherein said predetermined amount may be adjusted to zero.

10. The device of claim 9 wherein the size each of said metering slide chambers is adjusted hydraulically.

11. The device of claim 1 wherein said dry ingredients also include sand and gravel, and wherein said plurality of hoppers further includes a sand hopper and a gravel hopper.

12. The device of claim 11 further comprising at least one vibrator attached to the surface of said sand hopper.

13. The device of claim 11 further comprising cement freeing means disposed substantially in the bottom of said cement hopper, said cement freeing means including, a rotary shaft, at least one feed auger for supplying cement to openings in the bottom of said hopper, and tines disposed over the openings in the bottom of said hopper for breaking up any caked cement present near the opening.

14. The device of claim 1 further including a truck frame, said mixing device being mounted to said truck frame to facilitate movement along highways wherein said gravel hopper is mounted on the side of the truck nearest the highway center line.

* * * * *